US009187866B2

(12) United States Patent
Sunblad et al.

(10) Patent No.: US 9,187,866 B2
(45) Date of Patent: Nov. 17, 2015

(54) COMPRESSION-MOULDED TRAY AND METHOD OF PRODUCING A FIBRE TRAY

(71) Applicant: SIG Technology AG, Neuhausen (SE)

(72) Inventors: Per Sunblad, Gothenburg (SE); Roger Soderlund, Grums (SE); Bengt Nordin, Mariehamn (FI); Lars Blecko, Marsta (SE)

(73) Assignee: SIG Technology AB, Neuhausen (CH)

( * ) Notice: Subject to any disclaimer, the term of this patent is extended or adjusted under 35 U.S.C. 154(b) by 0 days.

(21) Appl. No.: 14/135,867

(22) Filed: Dec. 20, 2013

(65) Prior Publication Data

US 2014/0110072 A1 Apr. 24, 2014

Related U.S. Application Data

(62) Division of application No. 12/294,602, filed as application No. PCT/SE2007/050190 on Mar. 27, 2007, now abandoned.

(30) Foreign Application Priority Data

Mar. 27, 2006 (SE) ..... 0600702

(51) Int. Cl.
*D21J 7/00* (2006.01)
*B65D 1/34* (2006.01)
*D21J 3/00* (2006.01)

(52) U.S. Cl.
CPC ... *D21J 7/00* (2013.01); *B65D 1/34* (2013.01); *D21J 3/00* (2013.01)

(58) Field of Classification Search
USPC ..... 162/116
See application file for complete search history.

(56) References Cited

U.S. PATENT DOCUMENTS

| | | | |
|---|---|---|---|
| 2,237,048 | A | 4/1941 | Carter |
| 3,944,125 | A | 3/1976 | Friedman |
| 4,337,116 | A | 6/1982 | Foster et al. |
| 4,426,466 | A | 1/1984 | Schwartz |
| 5,115,624 | A | 5/1992 | Garwood |
| 5,356,518 | A | 10/1994 | Kelley et al. |
| 5,587,048 | A | 12/1996 | Streisel et al. |
| 5,653,915 | A | 8/1997 | Pardikes |
| 5,705,239 | A | 1/1998 | Andersen et al. |

(Continued)

FOREIGN PATENT DOCUMENTS

| | | |
|---|---|---|
| DE | 1922668 | 9/1965 |
| EP | 0245005 A2 | 11/1987 |

(Continued)

OTHER PUBLICATIONS

Smook, "Secondary Fiber", Handbook for pulp and paper technologies, Chapter 14, pp. 209-219.

(Continued)

*Primary Examiner* — Jacob Thomas Minskey
(74) *Attorney, Agent, or Firm* — Pierce Atwood LLP; Kevin M. Farrell

(57) ABSTRACT

A compression-molded tray of fiber material, said tray being formed of fiber material in a compression method, from a suspension of mechanical pulp of cellulose. The formed tray has been formed by press-drying using heat to a dry content of 80-95%, preferably 90-95%, and the fiber material of the formed tray has a density in the order of 400-650 kg/m3. The inside of the tray is provided with a protective barrier.

11 Claims, 2 Drawing Sheets

(56) References Cited

U.S. PATENT DOCUMENTS

| | | | | |
|---|---|---|---|---|
| 5,818,016 | A | 10/1998 | Lorence et al. | |
| 5,916,615 | A | 6/1999 | Brady et al. | |
| 6,099,688 | A | 8/2000 | Pere et al. | |
| 6,245,199 | B1 | 6/2001 | Lee | |
| 6,531,196 | B1 | 3/2003 | Aho et al. | |
| 6,537,680 | B1 | 3/2003 | Norlander et al. | |
| 6,988,614 | B2 | 1/2006 | Hemingway et al. | |
| 2002/0012759 | A1 | 1/2002 | Asayama et al. | |
| 2003/0183637 | A1 | 10/2003 | Zappa et al. | |
| 2004/0040882 | A1 | 3/2004 | Hemingway et al. | |
| 2004/0084166 | A1 | 5/2004 | Nonomura et al. | |
| 2006/0048909 | A1 | 3/2006 | Yeh et al. | |
| 2006/0198972 | A1 | 9/2006 | Ueda et al. | |
| 2006/0269707 | A1 | 11/2006 | Berbert | |
| 2007/0151687 | A1 * | 7/2007 | Halabisky | 162/146 |
| 2007/0164035 | A1 | 7/2007 | Blucher | |
| 2008/0264587 | A1 | 10/2008 | Champ et al. | |

FOREIGN PATENT DOCUMENTS

| | | | | |
|---|---|---|---|---|
| EP | 0303250 | | | 4/1993 |
| EP | 0562590 | A1 | | 9/1993 |
| EP | 1160379 | A2 | | 5/2001 |
| EP | 1126083 | A1 | | 8/2001 |
| EP | 1145822 | A1 | | 10/2001 |
| GB | 1136925 | | | 12/1968 |
| JP | 2002096813 | A | * | 4/2002 |
| JP | 2006225022 | | | 8/2006 |
| SE | 303250 | | | 7/1968 |
| SE | 444405 | | | 4/1986 |
| WO | 9615903 | A1 | | 5/1996 |
| WO | 01/39968 | A1 | | 6/2001 |
| WO | 2006/057610 | A2 | | 6/2006 |
| WO | 2006057609 | A1 | | 6/2006 |
| WO | WO 2006057610 | A2 | * | 6/2006 |
| WO | 2007111567 | A1 | | 10/2007 |

OTHER PUBLICATIONS

SkogsSverige: Mekanisk Massa, http://skogssverige.se/massaopapptillv/mekmassa.cfm?sid=7, Sep. 24, 2008.

STFI-Packforsk AB, Rapport MIK08-053, Aug. 20, 2008.

Koubaa, et al.; "Surface analysis of press dried-CTMP paper samples by electron spectroscopy for chemical analysis" Journal of Applied Polymer Science,;Jan. 23, 1996; vol. 61,;pp. 545-552.

* cited by examiner

COMPRESSION-MOULDED TRAY AND METHOD OF PRODUCING A FIBRE TRAY

FIELD OF THE INVENTION

The present invention relates to a compression-moulded tray of fibre material, said tray having an opening, an inside and an outside.

BACKGROUND

The handling of foodstuff put very high demands on the packaging. They must meet the hygienic requirements, i.e. bacteria and flavouring agents should not be able to migrate through the packages to and from the surrounding environment. In some cases the tray should even be gas tight, i.e. for chilled food for long storage or fresh meat in modified atmosphere. They should have enough strength to resist the handling during storage and transport. Tough environmental demands are also put on the packaging, i.a. as to recycling, composting or burning of used packages.

It has become more and more common with ready-cooked food dishes, and in addition to serving as a package for storage of the foodstuff, there are also requirements that it should be possible to put the packages directly into a microwave oven or a conventional oven for cooking or heating of the food dishes.

Packages in the form of aluminium forms are nowadays used to a great extent. They resist conventional ovens, but the disadvantages are that they become very hot and sometimes even impossible to hold in your hands. Aluminium forms are also very fragile and cannot resist a great load. Moreover, they cannot be put in a microwave oven Another common type of packaging is a tray of foamed, vacuum-formed or casted polyester. An essential disadvantage with solid or foamed plastic trays is that they cannot be put in a conventional oven, since they will then melt. The same will thing also happens with solid plastic trays that are common in convenient stores nowadays.

In U.S. Pat. No. 6,245,199 a method of mould-casting trays, where the starting material is a suspension comprising cellulose fibres, is described. Moulds are dipped, from above, in a bath of the suspension, after which the compression-moulding is performed under heat.

The choice of material suggested in the U.S. patent for the forming pulp is however not optimal for the manufacturing process and results in a formed tray lacking in function. Moreover, there is no specification of the pulp, only how the machinery works. Also, the described manufacturing process and assembling have some flaws like low and uneconomical production rate, large areas that have to be well sealed against air leakage. Air pressure from the back of the moulds demands extremely good rigidity as the tool tolerances, when in contact, are less than 1 mm. This results in bad reproducibility and a decreased quality of the trays. The tools used may also cause crushing of cellulose at certain locations on the tray.

It is known to form trays from a starting material in the form of a paper web normally comprising multiple layers. The forming is performed by stretch-forming the web using a pressing tool. One example of a method of this kind is described in EP 1 160 379-A2. This document suggests the use of a paper web that has been improved as regards its stretchability and elasticity, properties that are important when the material is to be stretched and deformed in order to form it.

The forming of trays from a material web is however associated with a number of disadvantages. Even if the flexibility and elasticity have been improved, as is indicated in EP 1 160 379-A2, there are still limitations with regard to its flexibility and elasticity, which in turn results in limitations in the formability. It is impossible to produce deep trays or multi compartment trays from a web, since it is impossible to form a tray or bowl from a flat sheet even if you have moistened it up to water a content 50%. Furthermore, undesired folds are formed when depressions are made in the material web in connection with the forming of the trays. The web used may even break. An essential disadvantage with the trays according to EP 1 160 379-A2, is that the formed trays are stretched and that they have built-in tensions that may cause the formed trays to be deformed when exposed to stresses in the form of changes in temperature or when exposed to moisture or dampness.

ACCOUNT OF THE INVENTION

By to the present invention, a tray with a considerably improved function compared to previously known methods has been achieved.

The tray according to the invention is characterised in that the tray in a compression method is formed from a suspension of a fibre material of cellulose, comprising at least 75% virgin fibre-based mechanical pulp from the group TMP, CMP, CTMP, cTMP, HTCTMP and mixtures thereof, and in that the formed tray has been formed by press-drying using heat to a dry content of 90-95%, in that the fibre material of the formed tray has a density in the order of 400-650 kg/m$^3$, and in that the tray on its inside is coated with a protective barrier.

By choosing the mentioned kind of virgin fibre-based mechanical pulp of cellulose as fibre material in the tray, several advantages are obtained. Fibres of mechanical pulp are stiffer than any other type of cellulose pulp, such as chemical pulp or pulp that is partly or fully comprised of recycled fibre. This means that the tray formed from mechanical pulp is more resistant to deformation. The remaining residues of natural resins in the mechanical pulp also causes the formed tray to be self-hydrophobing, which is important in order for the tray to maintain its shape and strength even in humid environments. Press-drying also introduces built-in stress into the product which gives the rigidity at a low basis weight. Said stress is evenly distributed and results in an additional contribution to the stability, due to the fact that the fibres have been forced to a shape under heat and pressure into a fibre network, Inner stress yields in this case a better strength and stability. The hydrophobic fibres also prevent future penetration of water, which in turn also promotes long-lasting strength and stability.

The formed tray has been formed by dry-pressing under heat to a dry content of 80-95%, preferably to a dry content of 90-95%. This results in the forming of very strong hydrogen bonds between the individual fibres, and in the obtaining of a tray with high resistance to compressive stress.

Press-drying is preferably performed at 250-280° C. This temperature interval results in a good production efficiency. Higher temperatures may result in burning of the fibre material.

By hard-compressing the fibre material in the compression method to a density in the order of 400-650 kg/m$^3$, a tray with high stiffness that can resist very high compressive loads is obtained. When compressing to this density, the fibre material is strong enough for use as food trays and will have a very good surface for lamination of various plastic films as PET (polyethylene terepthalate), PA (polyamide), PP (polypropylene), and PBT (polybutylene terephthalate). Both higher and lower densities will create lamination and tightness problems. The correct smoothness of the surface is a very crucial property and is very much linked to the density of the tray. If for instance the density is too low (<400 kg/m$^3$), the surface will be too rough, causing pinholes in the lamination film. If the density is too high (>650 kg/m$^3$). the surface will be too smooth and the lamination film will not adhere/anchor well enough to the fibres.

According to a suitable embodiment, the invention is further characterised in that said mechanical pulp comprises at least 75% CTMP.

According to one embodiment, particularly intended for the use as a tray for foodstuff, such as ready-cooked food dishes, the invention is characterised in that said protective barrier is constituted by an aqueous plastic emulsion.

A plastic emulsion of the above-mentioned kind is sprayed on the fibre tray and subsequently "polymerised" (forming a film during drying just like water-based paint) to a plastic film.

According to one embodiment, the invention is characterised in that said film of PET, PA, PP, PBT or similar is applied on the formed tray through heat-lamination. The film can be clear, transparent and/or coloured. Normally, a black film is preferred. A black film greatly facilitates the heat-lamination to the formed fibre tray, since the added heat to a higher degree is absorbed by a black material than by other colours. By using a black film, it is thus possible to achieve a sufficiently high and even lamination temperature PET has unique properties which makes is particularly suitable for the intended application purpose. In connection with the lamination, the PET film changes from an amorphous to a crystalline molecular structure. In crystalline form, the PET can resist both heating and freezing. PET has in crystalline form a softening temperature of approximately 220° C., which makes it resist heating in a conventional oven. Moreover, PET in crystalline form is gas-tight and protects well against migration of bacteria and flavouring agents.

In some cases PA, PP, PBT alone or in combination with EVOH (ethylene vinyl alcohol copolymer) may be more suitable. The choice of film material depends on what degree of air-tightness is needed and how the food is processed inside the tray, will the tray be top sealed with another film or not. If for example an air-tight tray is desired, i.e. suitable for chilled food for long storage, a co-extruded film with EVOH is suitably used, as this is one of the most air-tight compounds after aluminium. For frozen food there are lower demands, and a PET or PA film is sufficient and may suitably be used.

PET in crystalline form can also resist vapour sterilisation (autoclavation), which is performed under high vapour pressure and at a temperature of 125-130° C. All polymers are not suitable for this type of sterilisation. During vapour sterilisation, the material gets in contact with vapour, which is something that not all polymers can resist, such as for example PVC, polyethylene, and polyamide.

Amorphous PET, so-called APET, has a very high tensile strength and can therefore be pressed down into very deep trays that are to be laminated. PET in crystalline form, so-called CPET, has also a high wear resistance and resistance to chemicals. PET is also a very suitable material as regards the environment. PET is easy to recycle from used trays. Due to the fact that PET has a very high tensile strength, it is easy to separate PET in large flakes from the rest of the tray. PET is also suitable for burning.

According to one embodiment, the invention is characterised in that the tray, by the press-drying, has been provided with a smooth surface structure without protruding fibres. By this, the risk of so-called "pin-holes" is eliminated.

According to one embodiment, the invention is characterised in that the tray has a planar bottom and side walls that are straight to said bottom. This facilitates the lamination to the plastic film. The use of straight side walls in relation to the bottom has been made possible thanks to the fact that the tray according to the invention, in contrast to other known trays for use as food package for ready-cooked dishes, has a considerably higher resistance to compressive load. Previously known trays are usually provided with special reinforcing bumps for obtaining an acceptable load strength. Irregularities in the form of reinforcing bumps results in a decreased lamination of the film.

According to one embodiment, the invention is characterised in that the opening of the tray is surrounded by an outwardly extending and with said bottom parallel and completely smooth rim. This has also been made possible by the fact that the tray according to the invention is built by material that is stiff and resistant to high compressive loads. A smooth rim facilitates the sealing of the tray with a lid.

According to one embodiment, the invention is characterised in that the tray is formed from a suspension of fibre material having a pH between 6 and 8.5, preferably between 7 and 8. It has been shown the tray is much stronger at a pH close to a neutral pH value. This is believed to be caused by the formation of stronger hydrogen bonds between the fibres at this pH value.

According to one embodiment, the invention is characterised in that the fibre material of the tray has been treated with a hydrophobing agent.

According to one embodiment, the invention is characterised in that said hydrophobing agent is constituted by AKD (alkyl ketene dimer) or ASA (alkyl succinic anhydride). These hydrophobing agents is suitable as it is resistant to both freezing and heating.

According to another aspect, the present inventions provides a method of manufacturing the above-mentioned trays.

According to another aspect, the present inventions provides a method of laminating films on a fibre material. Said method enables lamination of various films to a fibre material. The method is particularly useful when using a film exhibiting increased E-modulus when stretched, such as PET, PA, and PBT films, since this will yield a very even film. Other films are also suitable, but are then preferably used in combination with another film.

DESCRIPTION OF THE DRAWINGS

The invention will in the following be described more in detail with reference to an embodiment, which is shown in the appended drawing. In this drawing.

DESCRIPTION OF EMBODIMENTS

Figure 1:
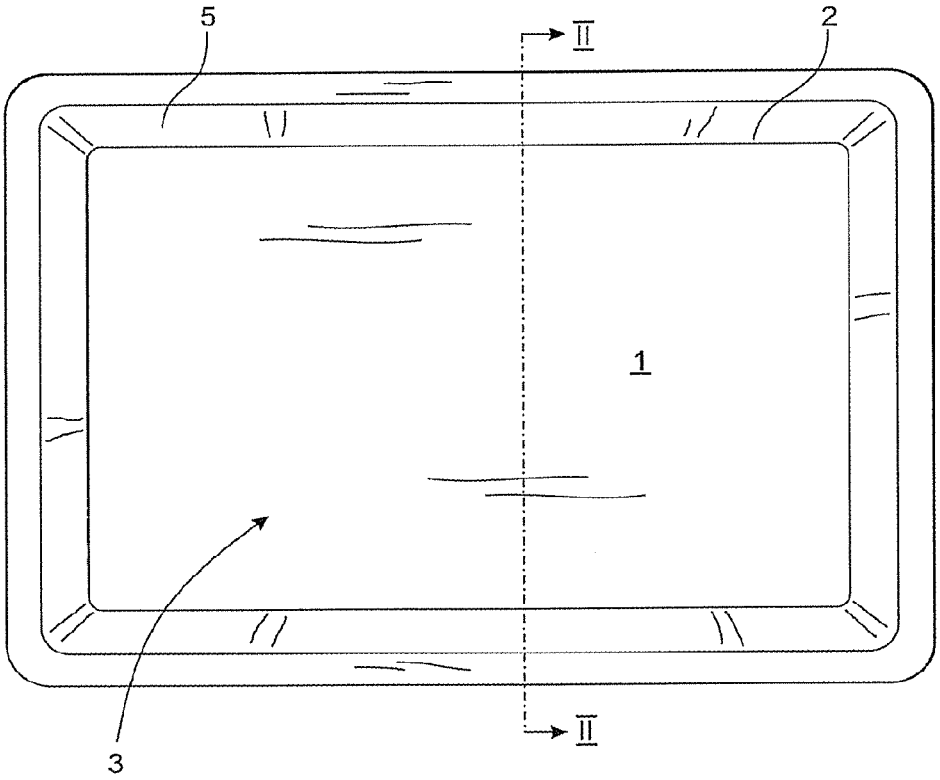
FIG. 1 shows an example of a tray according to the invention seen from above.
Figure 2:
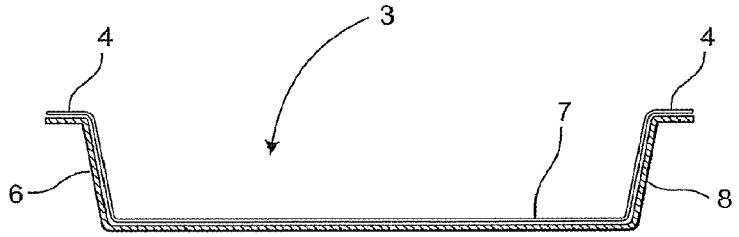
FIG. 2 shows a cross-section along the line II-II.

The shown tray has a planar bottom 1 and from that straight side walls 2, which surround an opening 3. The opening of the tray is surrounded by an outwardly extending and with said bottom parallel and completely smooth rim 4. The tray has an inside and an outside. The tray is formed from a suspension of a fibre material of mechanical pulp having a pH between 6 and 8.5, preferably between 7 and 8. It has been shown that the tray becomes stronger when formed from a fibre suspension having an essentially neutral pH value. The inside of the tray is coated with a film 7 of PET or another film as mentioned above. The compression-moulded fibre tray has been denoted by 8.

The manufacturing of the tray according to the invention is in principle performed in the following way.

Dewatering trays having a shape that corresponds to that of the shape of the tray to be manufactured is immersed into a bath in the form of a suspension of mechanical pulp. The fibre material suitably comprises at least 75% CTMP. The fibre material of CTMP has the advantage that is self-hydrophobing and results in a more porous and thus more air-permeable structure than for example ground pulp, which in turn improves the forming in the dewatering trays. CTMP is also advantageous during the subsequent lamination with PET, as air can more easily pass through the more porous structure in a formed fibre tray of CTMP compared to other mechanical pulps. The dewatering trays for a fibre suspension of CTMP suitably have a mesh size of 60 mesh or finer.

After the formation in the dewatering trays, the trays are transferred to a pressing tool where press-drying under heat and high compressive pressure takes place in one or several steps. Press-drying under heat should be continued until the compression-moulded fibre tray has reached a dry content of 80-95%, preferably 90-95%. In order to obtain a stiff fibre tray, it is important that the press-drying under heat is performed to the said dry content. It is not before this dry content that the desired strong hydrogen bonds between individual fibres are developed.

Furthermore, the compressive pressure in the press-tools should be so high that the fibre tray gets a density in the order of 400-650 kg/m$^3$. If the density is too low, the surface will be to rough, causing pinholes in the lamination film. On the other hand, if the density is too high density, a very smooth surface is produced, and the film will not glue/stick to the fibre material. It has been shown that a formed fibre tray having said properties gets particularly good properties for use purposes, in which the tray is exposed to great stresses in the form of high compression loads, high heat under prolonged periods, freezing, as well as liquids and moisture. An example of a suitable application field is packages for ready-cooked dishes, where the stresses of the above-mentioned kind are present and where there are no known suitable solutions that can withstand both conventional and microwave-heating, and still can be taken out from said ovens with bare hands.

According to one embodiment, a hydrophobing agent is added to the fibre suspension. The intention is that the formed fibre tray thus should become strongly water-repellent. Absorption of water would result in a great reduction of the tray's resistance to loads. According to a suitable embodiment, the hydrophobing agent is AKD (alkyl ketene dimer). The advantage with this hydrophobing agent is that it is resistant to both heating and freezing.

According to a suitable embodiment, the fibre trays are laminated on their inside with a film of PET. A film of PET is particularly suitable. PET has a high tensile resistance, which makes it possible to stretch the film in connection with the lamination to the fibre tray without it braking. When using a film of PET having a thickness of 50 μm, trays having a depth of at least 5 cm can be formed without problem.

The film is applied as a web over the pre-formed fibre tray and is sucked down into the tray using vacuum, while the film is heated for lamination using heat radiation.

The PET film is suitably black, for the reasons described above. It may also be clear, transparent and/or coloured. The PET film is constituted of amorphous polyester. The colouring is performed by a so-called master batch, comprising colour pigments in concentrated form, in connection with the extrusion of the film. During stretching of the film, in connection with the lamination, the film is extended and the thickness of the film will in a laminated state be less than 50 μm. During the lamination process, the amorphous structure is crystallised and is transformed into CPET, i.e. a crystalline polyester. A film of CPET having a thickness of approximately 10 μm is essentially gas-tight and bacteria-tight. CPET film has a low moisture absorption, high wear resistance and is resistant to chemicals. Depending on end use, other films may be more suitable. When the tray needs a top film to protect the food, it may sometimes be difficult to glue a film on CPET. In such cases, a top film of PA/PP film is easier to glue/adhere to said tray. There is always a co-operation between different films and the choice of top and lamination film must always be judged and tested individually.

The pressing tools for the press-drying are suitably completely smooth in order to achieve a surface structure on the formed tray that is smooth and without protruding fibres, which may give rise to "pin holes" in the plastic film during its lamination.

In the following, tests that have been performed on an embodiment in the form of a fibre tray of CTMP and a PET film laminated to said fibre tray.

The tested trays have a very good surface finish, good stability and high heat insulation capacity, which make them well suited for e.g. heating of ready-cooked dishes in microwave and conventional ovens. The good heat insulation capacity makes it possible to hold the tray containing the heated dish in the hand, without any risk of getting burned.

The migration is very low, whereby the trays are well suited for direct contact with foodstuff. When packaged in a modified atmosphere, a plastic laminate having a low permeability is suitable.

The form stability of the trays makes them suitable for automated handling in filling and packaging machines.

The tests have been performed on the heat resistance of the trays, filled and unfilled, to verify that they can be used for serving hot food and in for example airplanes. As is seen below, the tests show that trays according to the invention have a very high heat resistance.

The trays have also been tested in respect of autoclavation and pasteurising, respectively, with good results. The tests have been performed with and without a plastic bag around the trays. The reason for using a plastic bag, is to simulate a tray sealed with a lid film, which should always be the case during autoclavation and pasteurising.

The trays have a very good stability and resist very high loads before any breakage has been observed.

In summary, it can be concluded that the trays are well suited for a large number of applications, both for foodstuff and technical products.

Description of the Manufacturing Process

Reslushed or fresh CTMP is formed on a wire net or similar device (from a consistency of about 1% up to about 15%) to its desired tray shape. The formed tray is then dried between hot tools in several stages with the help of vacuum and compressed air, to the desired dryness of about 90%, which is suitable for imparting a sufficient rigidity to the tray. Additional hydrophobising agents and retention aids are added to the stock before dewatering in order to improve the production, since the retention aids speeds up the dewatering process and binds the fine material (very small fibre fragments) to the fibre web. The performance of the production is improved since a large part of the hydrophobing agents stick to the fine material, and the retention aids keeps said fine material from being flushed out with the white water. The provision of the barrier-coating or lamination takes place immediately after the trays have been dried to about 90% dryness. The trays may be checked with a metal detector before delivery to the user, since metal fragments are completely forbidden in food trays for many reasons, e.g. it may be harmful to get sharp pieces if metal into your body and if metal pieces are put into a microwave oven, they can cause a fire

EXAMPLES

Tested Materials

Polyester-laminated fibre trays formed of CTMP from a suspension. The dimensions of the trays were 173×117×30 mm.

Testing

Surface weight measurements were performed according to ISO 536:1995. Samples were taken from the bottom and the side walls of the trays.

Measurements of the thickness and density were performed according to ISO 534:1998. Samples were taken from the bottom and the side walls of the trays.

Measurements of the tear strength were performed according to ISO 1974:1990. Samples were taken from the bottom and the side walls of the trays.

Absorption of Water

A. The weights of the trays were measured, after which the whole tray was submerged under water for 60 seconds. After drainage of the water and drying in air for 1 minute, the tray was weighed again. The gain in weight was reported.

B. The weights of the trays were measured, after which they were filled with 5 dl of water and were left to stand in room temperature for 24 hours. After 1 minute (B1), and 15 minutes (B2) of drying time, the tray was weighed again. The gain in weight was reported.

Measurements of the compressive strength were performed between plane-parallel loading plates with a compression speed of 10 mm/minute. The maximal load capacity of the trays was measured on new trays, 0-tests, and on trays after autoclavation.

Autoclavation was performed on 5 trays, each filled with 100 ml of water. The trays were autoclavated at different temperatures and times, both enclosed in plastic bags and without plastic bags.

The temperatures and times were 120° C. for 60 minutes, 100° C. for 45 minutes, and 90° C. for 1 minute (pasteurisation), after which the trays were dried in drying chambers at 50° C. for 1 hour.

1 tray from each temperature was compression-tested.

Tests of fire smoke was performed on 6 trays filled with lasagne. The trays were placed in a Regina Culinesse hot air oven from Husqvarna having a temperature of 225° C.±5° C. under 90 minutes. Any presence of fire smoke was judged visually by two independent persons.

Empty trays were tested to control possible ignition in oven. The temperature was measured by infrared non-contact temperature meters. At a surface temperature of 290° C., the underside of the trays was discoloured, but apart from that, the trays were intact. No ignition occurred, which is in line with previous experience, namely that organic material like cellulose does not normally self-ignite in temperatures below 400° C. Kitchen ovens are also limited to 300° C. to prevent self-ignition.

Result

| | Thickness (μM) | | Surface weight ($g/m^2$) | | Density ($kg/m^3$) | |
|---|---|---|---|---|---|---|
| Tray | Bottom | Side | Bottom | Side | Bottom | Side |
| 1 | 1168 | 748 | 581 | 456 | 497 | 609 |
| 2 | 1436 | 773 | 594 | 483 | 414 | 625 |
| 3 | 1341 | 703 | 596 | 476 | 445 | 677 |
| 4 | 1474 | 805 | 626 | 526 | 425 | 654 |
| 5 | 1466 | 852 | 633 | 523 | 432 | 614 |
| 6 | 1322 | | 597 | | 452 | |
| 7 | 1346 | | 591 | | 439 | |
| 8 | 1345 | | 667 | | 496 | |
| 9 | 1332 | | 654 | | 491 | |
| 10 | 1143 | | 594 | | 520 | |
| Average | 1337 | 776 | 613 | 493 | 461 | 636 |
| Std. dev. | 111.5 | 56.4 | 29.7 | 30.6 | 36.6 | 28.9 |

| | Tear strength (mN) | | Tear index ($Nm^2/kg$) | |
|---|---|---|---|---|
| Tray | Bottom | Side | Bottom | Side |
| 1 | 8290 | 5990 | 14.3 | 13.1 |
| 2 | 8060 | 4750 | 13.6 | 9.8 |
| 3 | 10600 | 8770 | 17.8 | 18.4 |
| 4 | 9420 | 4280 | 15.1 | 8.1 |
| 5 | 8490 | 5290 | 13.4 | 10.1 |
| 6 | 5450 | | 9.1 | |
| 7 | 6540 | | 11.1 | |
| 8 | 9330 | | 14.0 | |
| 9 | 7760 | | 11.9 | |
| 10 | 6380 | | 10.8 | |
| Average | 8032 | 5816 | 13.1 | 11.9 |
| Std. dev. | 1569.8 | 1769.8 | 2.5 | 4.0 |

The abbreviation Std. dev. stands for standard deviation.

| Absorption of water | | | | | | |
|---|---|---|---|---|---|---|
| | A | B-1 | | B-2 | | |
| Tray | g | % | g | % | G | % |
| 1 | 2.1 | 12.8 | 0.75 | 4.3 | 0.73 | 4.3 |
| 2 | 1.8 | 11.4 | 0.81 | 4.6 | 0.78 | 4.6 |
| 3 | 1.9 | 12.6 | 0.27 | 1.6 | 0.27 | 1.6 |
| 4 | 1.9 | 11.6 | | | | |
| 5 | 1.7 | 10.4 | | | | |
| Average | 1.6 | 11.8 | 0.6 | 3.5 | 0.6 | 3.5 |
| Std. dev. | 0.15 | 0.97 | 0.30 | 1.65 | 0.28 | 1.65 |

Compression to maximum load in N, compression in mm

| 0-test | | |
|---|---|---|
| Tray | N | mm |
| 1 | 531 | 7.6 |
| 2 | 602 | 6.9 |
| 3 | 576 | 6.7 |
| 4 | 489 | 6.4 |
| 5 | 488 | 11.1 |
| Average | 537.2 | 7.7 |
| Std. dev. | 51.2 | 1.93 |

| After autoclavation 1 min. N | 90° C. mm | |
|---|---|---|
| 567 | 6.7 | With plastic bag |
| 553 | 12.0 | Without plastic bag |

| After autoclavation 45 min. N | 100° C. mm | |
|---|---|---|
| 572 | 8.8 | With plastic bag |
| 427 | 9.3 | Without plastic bag |

| After autoclavation 60 min. | 120° C. | |
|---|---|---|
| N | mm | |
| 573 | 9.9 | With plastic bag |
| 493 | 7.1 | Without plastic bag |

Visual Judgment of the Fire Smoke

After a few minutes in the oven at a temperature of 225° C., the plastic began to come off at the edges of all trays. After 90 minutes, the outside of the trays was slightly brown-coloured. No smoke could be detected. The packaged foodstuff was relatively charred on the upper side.

Ignition Test

The surface of the tray became brown, but the rest of the tray remained intact at 290° C. No ignition occurred.

In addition to the tests mentioned above, the above-mentioned trays were also tested as to migration. Tests were performed according to ISO EN-1186-14, which is intended for migration-testing of plastics, that when used, get in contact with fatty foodstuff. The test media were constituted by iso-octane and 95% ethanol.

Total Migration

| Sample | Media | Test conditions | Total migration ($mg/dm^2$, sample) | Average |
|---|---|---|---|---|
| 1 | 95% ethanol | 6 h 60° C. | −0.6; −0.5; −0.6 | <1 |
| 1 | iso-octane | 4 h 60° C. | −0.1; −0.4; −0.3 | <1 |

The migration average is based on a triple analysis according to EN-1186. The accepted value of migration in packages for food is <10 $mg/dm^2$.

The transmission of oxygen through the plastic film and the fibre material was measured according to ASTM D 3985-95 using a so-called "coulometric sensor".

Oxygen-transmission Result

| Sample | Test conditions | Area ($cm^2$) | Transmission of oxygen ($cm^3/m^2/day$) | Average |
|---|---|---|---|---|
| 1 | 23° C., 0% RH | 5 | 278.81; 213.99 | 246.4 |

The transmission of water vapour through the plastic film and the fibre material were measured according to ASTM F 1249-90 using a modulated infrared sensor.

Transmission of Water Vapour

| Sample | Test conditions | Area ($cm^2$) | Transmission of water vapour ($cm^3/m^2/day$) | Average |
|---|---|---|---|---|
| 1 | 23° C., 100% RH | 5 | 45.46; 63.65 | 54.6 |

The invention is not limited to the above-described embodiments, but can also be modified within the scope of the following patent claims.

The chosen materials and method of manufacturing according to the invention enable a free selection of the shape of the tray. The walls of the tray need of course not be straight vis-à-vis its bottom, but may have any arbitrary curved shape. The rim need not be parallel with the bottom of the tray, but may be curved.

The trays according to the invention, having a thickness in the order of 1 mm, results in, as is apparent from the reported tests, a high load resistance. Said resistance may of course be increased more by choosing a thicker tray. The manufacturing process using compression-moulding also makes it possible to reinforce the tray locally, by for example designing the tray with thicker reinforcement beams, which are formed in connection with the compression-moulding.

AKD has proven to be a suitable hydrophobing agent. Other hydrophobing agents are however possible. If the tray is to be used for ready-cooked dishes, then a hydrophobing agent that resists both freezing and heating should be chosen.

Black PET film gives a high and even lamination temperature. The PET film may within the scope of the invention be selected in an arbitrary colour, and may be provided with a colour-print with text and/or pattern, for example a picture pattern.

Other films like PA, PP, PE, PBT, sometimes in combination with EVOH, may also be used depending on end use/customer demands, such as the addition of customer profiles, length of food storage, conditions under which the storage is to take place, etc.

In the above-described embodiments, the fibre material is constituted by CTMP. The invention is however not limited to the selection of CTMP. Other fibre materials are possible within the scope of the following patent claims.

The tray according to the invention is formed from a suspension of a fibre material of cellulose comprising at least 75% virgin fibre-based mechanical pulp from the group TMP, CMP, CTMP, cTMP, HTCTMP and mixtures thereof. By the term cTMP, as is well-known by the person skilled in the art, is meant a CTMP with a lower amount of added chemicals. The term HTCTMP is also known by the person skilled in the art and relates to a high-temperature CTMP.

Smaller additions of other types of cellulose pulp than those of the above-mentioned group or mixtures thereof are possible within the scope of the following patent claims. For example, an addition of chemical pulp or recycled pulp, or mixtures thereof, is possible.

What is claimed is:

1. A method of producing a fibre tray, comprising the steps of:

a. forming a fibre tray by immersing a dewatering tray having the shape of the tray to be produced into a bath of a suspension of mechanical pulp and dewatering the suspension in the dewatering tray, the mechanical pulp comprising at least 75% virgin fibre-based mechanical pulp from the group, CMP, CTMP, cTMP, HTCTMP and mixtures thereof;

b. press-drying using a suitably smooth pressing tool and heating the formed tray to a dry content of 80-95% and a density of 400-650 kg/m3; and c. coating the dried fibre material with a protective barrier having a thickness of 50 μm or less producing a coated press-dried fibre tray, wherein the coating is free of pin-holes.

2. The method according to claim 1, wherein said press-drying is performed at 250-280° C.

3. The method according to claim 1, wherein said protective barrier is applied by coating a surface of the formed fibre material with a plastic emulsion that is polymerised to a film by the addition of an initiator, or dries to a film, on the tray.

4. The tray according to any of claim 1, wherein said protective barrier is constituted by a film of PET, PA, PP, PE, PBT, EVOH or combinations thereof.

5. The method according to any of claim 1, wherein said film or protective barrier is secured to the formed tray by heat-lamination.

6. The method according to claim 1, wherein the tray is formed from a suspension of fibre material having a pH between 6 and 8.5, preferably between 7 and 8.

7. A method of laminating a film or a protective barrier on a fibre material comprising at least 75% virgin fibre-based mechanical pulp from the group CMP, CTMP, cTMP, HTCTMP and mixtures thereof, comprising the steps of:

a. press-drying using a suitably smooth pressing tool and heating the fibre material to a dry content of 80-95% and a density of 400-650 kg/m3;

b. applying said film or protective barrier on said fibre material; and c. laminating said film or protective barrier on said fibre material producing a protected fibre material having a protective barrier having a thickness of 50 μm or less and free of pin-holes in the protective barrier.

8. The method according to claim 7, wherein said protective barrier is applied by coating a surface of the formed fibre material with a plastic emulsion that is polymerised to a film by the addition of an initiator, or dries to a film, on the tray.

9. The method according to claim 7, wherein said film or protective barrier is secured to the formed tray by heat-lamination.

10. The method of according to any of claim 7, wherein the applied film is PA, PP, PE, PBT, EVOH, APET, or combinations thereof.

11. The method of according to any of claim 7, wherein the applied film is a film exhibiting increased E-modulus when stretched.

* * * * *

UNITED STATES PATENT AND TRADEMARK OFFICE

CERTIFICATE OF CORRECTION

PATENT NO. : 9,187,866 B2
APPLICATION NO. : 14/135867
DATED : November 17, 2015
INVENTOR(S) : Sunblad et al.

It is certified that error appears in the above-identified patent and that said Letters Patent is hereby corrected as shown below:

On the title page item 71, replace "(SE)" with --(CH)--

On the title page item 73, replace "AB" with --AG--

Signed and Sealed this
Twenty-second Day of March, 2016

Michelle K. Lee

Michelle K. Lee
*Director of the United States Patent and Trademark Office*